US007610913B1

(12) United States Patent
Resnick

(10) Patent No.: US 7,610,913 B1
(45) Date of Patent: Nov. 3, 2009

(54) FLUID IMPERMEABLE INTERFACE FOR PROTECTIVE MATERIALS

(75) Inventor: Todd A Resnick, Stuart, FL (US)

(73) Assignee: TMR-E, LLC, Tampa, FL (US)

( * ) Notice: Subject to any disclaimer, the term of this patent is extended or adjusted under 35 U.S.C. 154(b) by 735 days.

(21) Appl. No.: 11/162,515

(22) Filed: Sep. 13, 2005

(51) Int. Cl.
*A41D 27/12* (2006.01)
*A42B 1/04* (2006.01)

(52) U.S. Cl. ..... 128/201.29; 128/201.22; 128/205.27; 128/206.21; 428/64.1; 428/66.4; 428/161; 428/172; 428/354; 2/202; 2/205; 2/468; 156/290; 156/291

(58) Field of Classification Search ..... 128/201.22, 128/201.23, 201.25, 206.21, 200.24, 205.27; 2/202, 205; 428/64.1, 66.4, 161, 172, 173, 428/354; 156/290, 291
See application file for complete search history.

(56) References Cited

U.S. PATENT DOCUMENTS

RE29,157 E * 3/1977 Petersen et al. ..... 524/271
4,816,330 A * 3/1989 Freund et al. ..... 442/397
5,113,854 A * 5/1992 Dosch et al. ..... 128/201.23
5,226,409 A * 7/1993 Bower et al. ..... 128/201.23
6,892,725 B2 5/2005 Frund
6,997,179 B1 * 2/2006 Niemann ..... 128/201.25
2003/0200966 A1 * 10/2003 Frund, Jr. ..... 128/201.29
2005/0193472 A1 * 9/2005 Courtney et al. ..... 2/202
2006/0032498 A1 * 2/2006 Niemann ..... 128/201.22
2006/0289004 A1 * 12/2006 Saez et al. ..... 128/201.24

* cited by examiner

*Primary Examiner*—Justine R Yu
*Assistant Examiner*—Clinton Ostrup
(74) *Attorney, Agent, or Firm*—Ronald E. Smith; Smith & Hopen, P.A.

(57) ABSTRACT

A fluid impermeable interface between a polymer hood and an elastomeric neck dam includes a film composite material having a fluid impermeable outer surface and a fibrous backing inner surface. At least one fiber-free fluid barrier channel is formed in the fibrous backing inner surface. An adhesive disposed within the at least one fiber-free fluid barrier channel bonds the elastomeric neck dam to the fibrous backing inner surface, forming a mechanical bond and a fluid barrier between the fibrous backing inner surface and the elastomeric neck dam.

9 Claims, 5 Drawing Sheets

FLUID IMPERMEABLE INTERFACE FOR PROTECTIVE MATERIALS

FIELD OF THE INVENTION

The present invention relates to fluidly sealing two substrates that are normally incompatible, more specifically, elastomeric surfaces to fibrous surfaces.

BACKGROUND

A relatively new category of respiratory protective equipment is the Chemical, Biological Radiological, and Nuclear (CBRN) Air-Purifying Escape Respirator (APER). Additional details on this category of equipment are available via the National Institute for Occupational Safety and Health (NIOSH) standard dated Sep. 30, 2003.

A major component of the CBRN APER is the CBRN protective hood. CBRN protective hoods are comprised of four major component parts: (1) an elastic neck dam; (2) a visor; (3) a harness and (4) a hood body (the entire hood excluding the neck dam, harness and visor). CBRN protective hoods (the hood body) can be made from lightweight film composites, such as TYCHEM® film composites sold by Dupont and ZYTRON® film composites sold by Kappler. Lightweight film composites (LFCs) offer many significant advantages over other barrier materials, such as PVC and butyl coated fabric. The advantageous characteristics of LFCs are as follows:

Thin and flexible material;

Can be heat fused to itself to form gas tight seams;

Excellent chemical holdout capability;

Excellent particulate holdout capability;

Can be hard folded and tightly compacted to minimize package size;

Will not take a hard set during desert storage conditions;

Will not yellow with aging;

Will not shatter when flexed in artic conditions; and

Can easily be interfaced with polyester (MYLAR® material), which is a preferred visor material.

MYLAR® material provides highly desirable optics, chemical resistance and anti-fog properties in view of competing visor materials. Other visor materials include PVC and Urethane.

The main disadvantage of LFC's is the problem of interfacing an elastomeric neck dam. The neck dam is an essential component of the CBRN protective hood. The neck dam can be made from neoprene, butyl, silicone or other elastic materials. The neck dam forms the bottom of the hood and provides the critical seal between the hood and the wearers' neck.

In normal use, the center hole in the neck dam is stretched open and then the entire hood is pulled over the wearers head. The neck dam is then released so that it can conform and seal to the wearers neck. The neck dam blocks contaminated air from entering the inside of the hood, and thus protects the wearer's entire head.

There must be a bond between the neck dam and the hood barrier material which is both mechanically strong and fluid tight. LFC's have a backing that is comprised of non-woven fibers which are permeable to air. The advantage of the fibers is that they provide a good attachment point for adhesive. The adhesive is able to encapsulate and lock onto the surface layer of fibers, which in turn provides a mechanically strong bond between the LFC and the elastic neck dam. However, the adhesive is not able to penetrate the entire layer of fibers and does not provide a gas tight seal.

Therefore, there is a need for a gas tight interface between LFC's and an elastic neck dam. The gas tight seal should withstand numerous challenges including:

(1) Hard folding and creasing;
(2) Tight vacuum compaction;
(3) 5 years of desert storage (71 C);
(4) 5 years of artic storage (−46 C);
(5) 5 years of cyclic storage (desert/arctic/desert);
(6) Mechanical stress during the hood donning process;
(7) Desert unfolding & donning;
(8) Artic unfolding & donning;
(9) Exposure to toxic chemical gases;
(10) Exposure to toxic biological particles;
(11) Exposure to toxic radiological particles;
(12) Shock; and
(13) Vibration.

Some protective hoods are made from PVC. PVC is a monolithic material that provides a solid and smooth surface to which an elastic neck dam can be bonded. The primary advantage of a PVC hood is that an elastic neck dam can be glued to the PVC material without a gas leak path caused by fibers. The adhesive will bond the PVC and elastic neck dam together and will also seal the gap between the two materials to prevent air or other gases from passing between the between the two materials. However, a PVC hood has many disadvantages.

PVC does not lend itself to the combination of hard folding, vacuum compaction, artic storage, desert storage or cyclic storage. Adhesive does not stick very well to PVC so the adhesive bond between PVC and an elastomeric neck dam will have limited mechanical strength. Typically, a neck dam can be separated from PVC with minimal force.

The weak bond strength between a PVC hood body and an elastic neck dam prevents a PVC protective hood from being hard folded in order to meet package size requirements for some government applications. PVC will shatter if unfolded at temperatures below freezing. PVC will take a hard set when stored in desert conditions. PVC visors cannot be treated with a permanent anti-fog. Polyester (MYLAR) visors that are treated with permanent anti-fog coatings such those sold under the brand name VISTEX by Film Specialties, Inc. cannot be fused or glued to PVC. Because PVC hoods do not lend themselves to hard folding, the resulting hooded respirators that use PVC hoods have a very large package size which makes them much less convenient to store, transport and carry.

In contra-distinction, hoods made from ZYTRON® material can be hard folded. The ZYTRON® material is much thinner, lighter and more flexible than PVC. ZYTRON® material does not take a set in hot storage and will not shatter when unfolded in artic conditions. A polyester (MYLAR®) visor coated with VISTEX® permanent anti-fog coating can easily be sealed to the ZYTRON® non-woven backing. ZYTRON® material is a more efficient chemical barrier than either PVC or butyl coated fabric.

A previous disadvantage of ZYTRON® material is that it is not a monolithic material and it does not provide a solid and smooth surface to which an elastic neck dam can be bonded and sealed. ZYTRON® is a composite material with a chemical barrier film on the outside and an air permeable material on the back side. The air permeable material is referred to as "non-woven" or "spun bond".

The non-woven backing, when examined under a microscope, is comprised of loosely packed fibers. Air, other gases and particles can easily pass laterally through the loose fibers. When an adhesive is applied to the non-woven substrate it is able to interlock with some of the fibers, but it is not able to penetrate and seal all of the fibers. Adhesives known in the art provide good mechanical bonds but do not provide a gas tight seal. The non-woven fibers can be melted and sealed to each other. However, the adhesive does not bond to slick, monolithic plastic, such as polypropylene. Thus, there exists a long-felt, but heretofore unfulfilled need in the art to create a gas tight seal between "non-woven" and elastic material without giving up the mechanical bond strength.

It should be noted that a gas tight material interface described herein can be used in various Chemical Biological Radiological Nuclear (CBRN) protective garments, including a protective hooded respirator.

SUMMARY OF INVENTION

The present invention includes a fluid impermeable elastomer-to-fibrous surface interface including an elastomeric substrate such as neoprene, butyl rubber or silicone affixed to the fibrous backing of a film composite material such as those under the brand names TYCHEM® available from DuPont and ZYTRON® available from Kappler. These film composite materials have a fluid impermeable outer surface and a fibrous backing inner surface. The outer surface is used for the exterior of protective hoods and garments while the fibrous backing is oriented to the interior of the protective hoods and garments.

At least one fluid barrier channel is formed in the fibrous backing. The fluid barrier channel may be preformed into the composite material but more typically is created by application of sufficient heat to melt the fibrous material into a smooth surface channel. The position of the fluid barrier channel is set to prevent the lateral migration of fluid through interstitial space within the fibrous backing of the film composite.

An adhesive is used to affix the elastomeric substrate to the fibrous backing inner surface in overlapping relation. The adhesive forms a mechanical bond between the fibrous backing and the elastomeric material. The adhesive also forms a fluid barrier by filling the void formed by the at least one barrier channel. Thus, the adhesive-filled channel becomes a fluid-impermeable gasket preventing lateral fluid flow across its boundaries.

It is preferred that the adhesive have good bonding properties to elastomeric materials. A polychloroprene-based adhesive such as that known under the brand name SILAPRENE® M6504 available through Uniroyal Technology Corporation is preferred for neoprene, butyl and other compatible elastomers. It is highly flexible, maintains bond strength in both desert and artic storage conditions. Silicone neck dams should be affixed with a silicone-based or otherwise silicone-compatible adhesive such as SUPER SILICONE SEAL® sold by 3M Corporation under Part No. 08661.

In at least one application, the elastomeric substrate forms an aperture through which a body part is projected and elastically sealed from fluid flow across the perimeter of the aperture. The body part may include a neck, wrists, arms, ankles, legs, a waist or the like. The aperture in the elastomeric substrate is typically annular. Accordingly, the fluid barrier channel formed in the fibrous material forms a concentric ring about the center axis of the aperture. A plurality of concentric rings of differing diameters provides a level of redundancy to the fluid barrier functionality of the invention.

A specific embodiment of the present invention includes a neck dam assembly for use with a protective respiratory hood. The neck dam itself is an elastomeric ring adapted to seal the interior of the hood encasing the head of a wearer from the outside environment. The neck dam forms the bottom of the hood and provides the critical seal between the hood and the wearers' neck. The neck dam may be constructed of neoprene, silicon, butyl or other elastic materials. In normal use, the center hole in the neck dam is stretched open and then the entire hood is pulled over the wearer's head. The neck dam is then released so that it can conform and seal to the wearer's neck. The neck dam blocks contaminated air from entering the inside of the hood and thus protects the wearer's entire head. A film composite ring is die cut to substantially the same outer diameter as the neck dam. The film composite ring has a fluid impermeable film outer surface and a fibrous backing inner surface. Before the inner surface of the ring is mated to the neck dam, a plurality of concentric fluid barrier channels are heat-formed into the fibrous backing inner surface of the ring, the channels having a smooth surface and forming a concentric bands about the center axis of the ring. An adhesive affixes the neck dam to the fibrous backing inner surface of the ring in overlapping relation whereby the adhesive forms a mechanical bond between the fibrous backing and the elastomeric material and a fluid barrier by filling the interstitial void formed by the barrier channels.

Once the neck dam assembly is completed it can be mated to the neck opening of a protective respiratory hood. Mating of the neck dam to the neck opening is accomplished by turning each component inside-out whereby the film side edges of the neck opening abut the film side edges of the neck dam assembly. A heat seam is formed about the film-to-film overlap thereby creating a strong mechanical bond and fluid seal. Once the hood is reversed from its inside-out state, an observer would see a seam formed around the outer perimeter of the hood neck opening.

DETAILED DESCRIPTION

Figure 1:
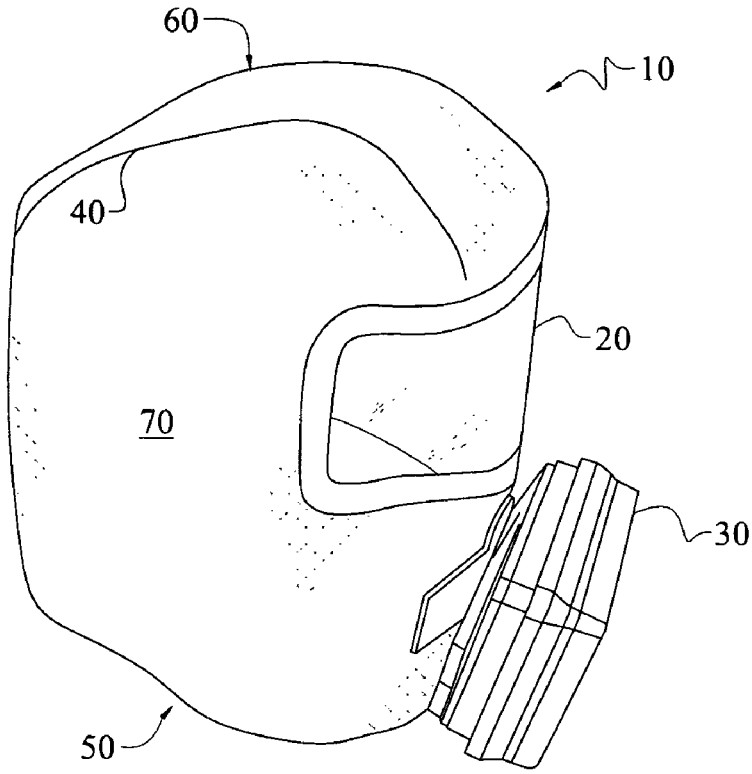
FIG. 1 is an elevated isometric view of a protective respiratory hood according to an embodiment of the invention.
Figure 2:
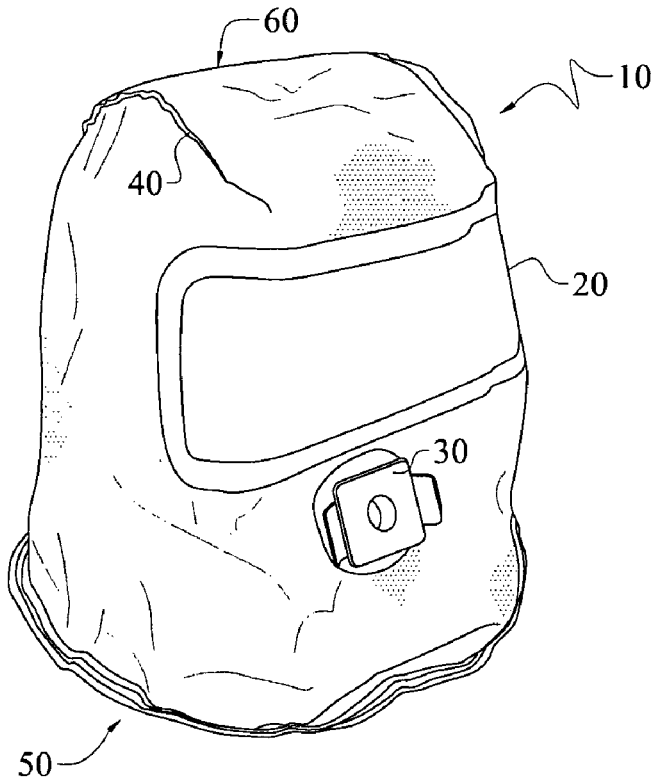
FIG. 2 is an elevated isometric view of the protective respiratory hood turned inside-out according to an embodiment of the invention.

Turning to FIG. 1, a respiratory protective hood is denoted as numeral 10 and is constructed of composite film material 70. Visor 20 provides outward vision and filter assembly 30 purifies outside air inhaled by the wearer. Hood top 60 and hood bottom 50 define the vertical dimensions of the hood which is placed over a wearer's head. Seam 40 joins two edges of material 70 to shape hood into a predetermined geometric configuration adapted to receive the head of a wearer. FIG. 2 illustrates hood 10 turned inside-out. Seam 40 is created by heat fusing two inwardly folded pleats of material 70 so the film-side of each respective section of material 70 is bonded together.

Figure 3:
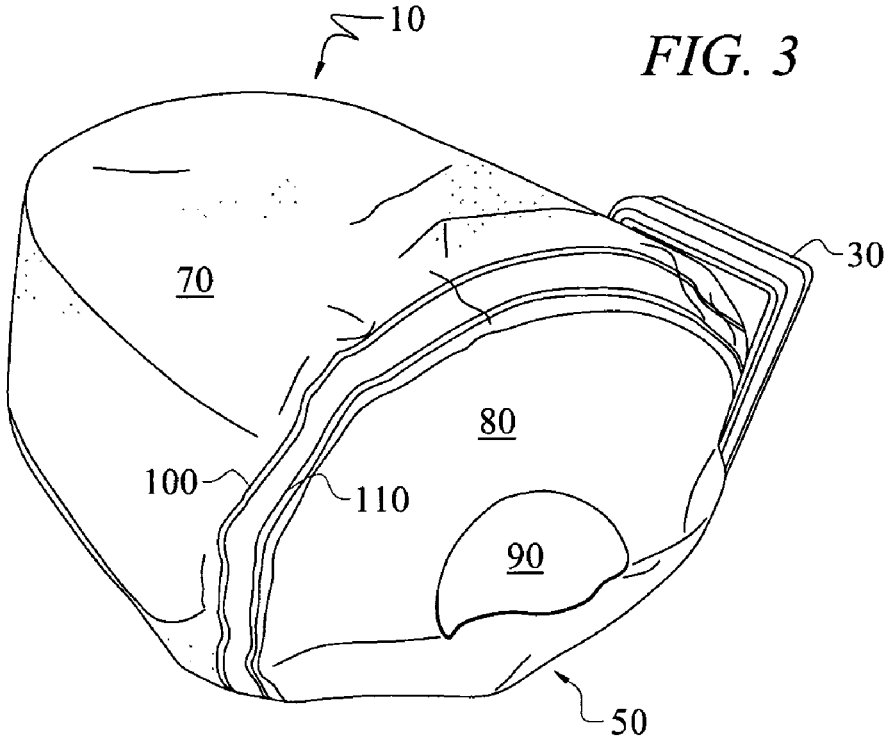
FIG. 3 is an elevated isometric view of the neck dam of the protective respiratory hood according to an embodiment of the invention.
Figure 4:
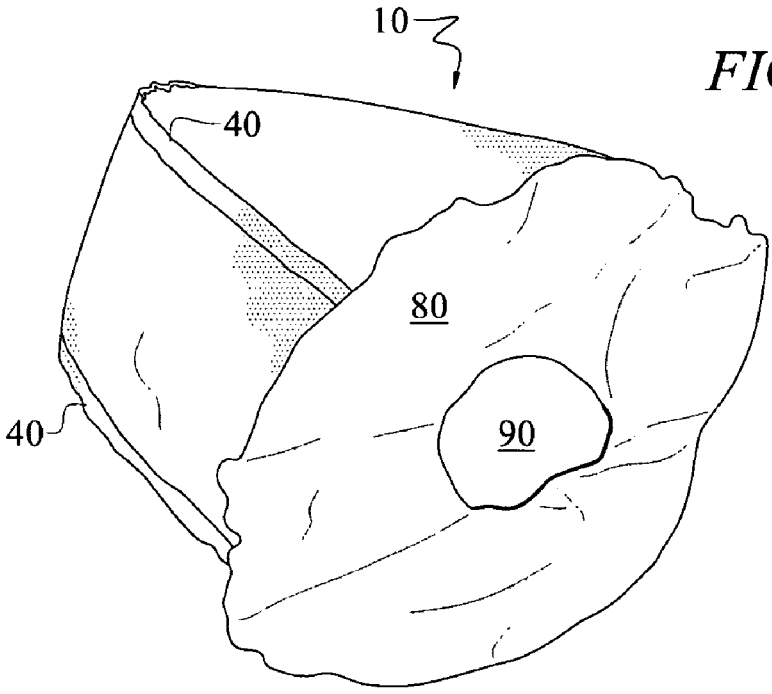
FIG. 4 is an elevated isometric view of the neck dam of the protective respiratory hood turned inside-out according to an embodiment of the invention.

FIG. 3 illustrates hood 10 showing bottom 50. Neck dam 80 has center aperture 90 through which a wearer's head is received. Aperture 90 seals about the neck of the wearer. The film-side of two concentric fluid barrier channels 100 and 110 are visible about the bottom circumference of hood 10. Channels 100 and 110 are formed by application of heat to composite material 70. Neck dam 80 overlaps channels 100 and 110 in the interior of the hood. FIG. 4 illustrates hood 10 turned inside-out showing neck dam 80.

Figure 5:
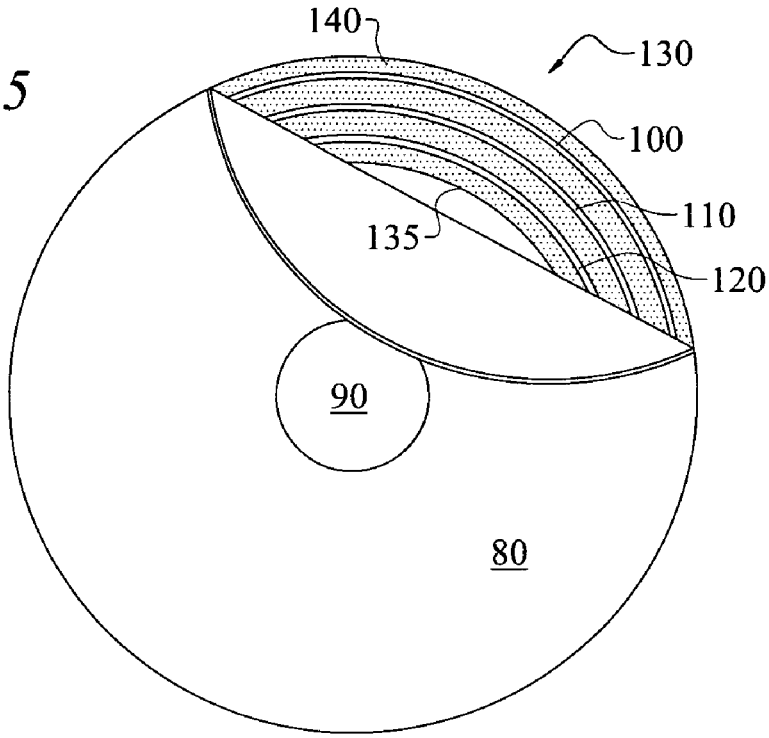
FIG. 5 is a bottom view of a partial neck dam assembly according to an embodiment of the invention.
Figure 6:
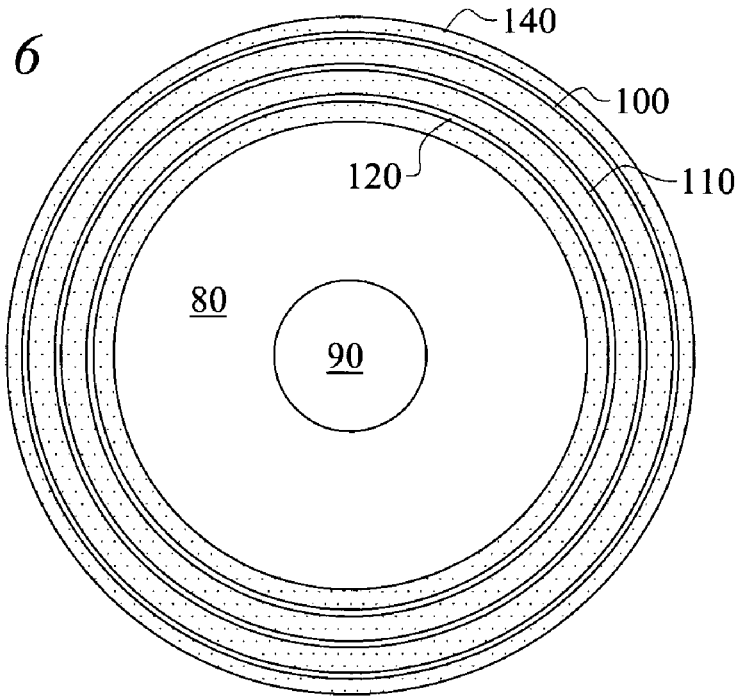
FIG. 6 is a top-down view of a neck dam assembly according to an embodiment of the invention.

FIGS. 5 and 6 illustrate neck dam assembly 130 having film composite ring 140 mated to neck dam 80. Three fluid barrier channels 100, 110 and 120 are heat-formed in the fibrous backing inner surface of ring 140. The channels have a smooth, flat surface formed in the normally porous fibrous backing of material 70. FIG. 5 shows neck dam 80 partially folded for illustrative purposes only to view channels 100, 110 and 120. The outer diameters of neck dam 80 and ring 140 are substantially the same. Inner ring edge 135 has a substantially greater diameter than aperture 90 of neck dam 80. This is because aperture 90 is flexible and will change diameters to accommodate donning of hood 10 as well as sealing to necks of various sizes. Material 70 is substantially non-elastic and thus neck dam 80 must be preformed or die cut with inner ring edge 135 having a substantially greater diameter than aperture 90.

Figure 7:
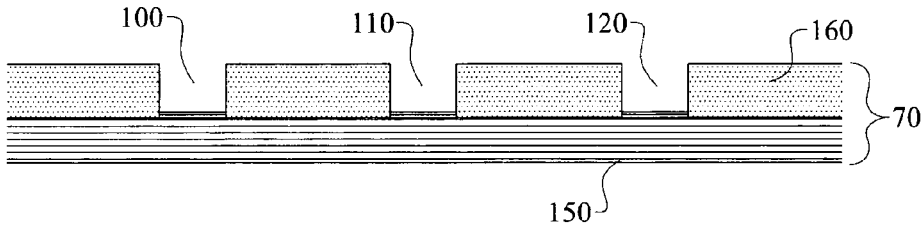
FIG. 7 is an elevated, sectional view of a composite material having film and fibrous layers with a plurality of channels formed therein.
Figure 8:
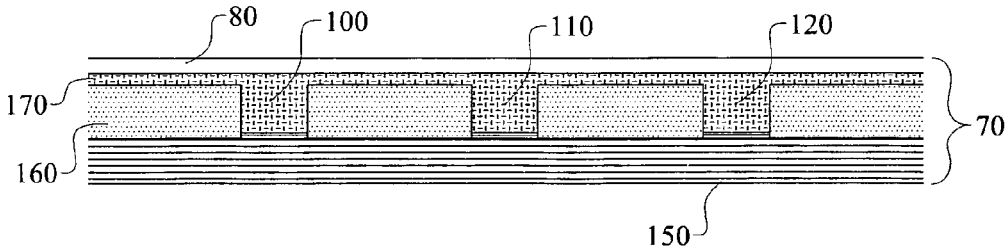
FIG. 8 is an elevated, sectional view of the composite material adhered to an elastomeric surface according to an embodiment of the invention.

FIGS. 7 and 8 illustrate a magnified, cross-sectional view of fluid barrier channels 100, 110 and 120 formed into material 70. Film side 150 of material 70 is opposite fibrous side 160. In FIG. 8, adhesive 170 fills fluid barrier channels 100, 110 and 120 forming a fluid-tight gasket. Adhesive 170 affixes neck dam 80 to material 70. Adhesive 170 forms a fluid tight and mechanical bond to neck dam 80. Adhesive 170 also forms a mechanical (but not fluid) bond to fibrous side 160. Lateral migration of fluid through fibrous side 160 is blocked by adhesive filled fluid barrier channels 100, 110 and 120.

Figure 9:
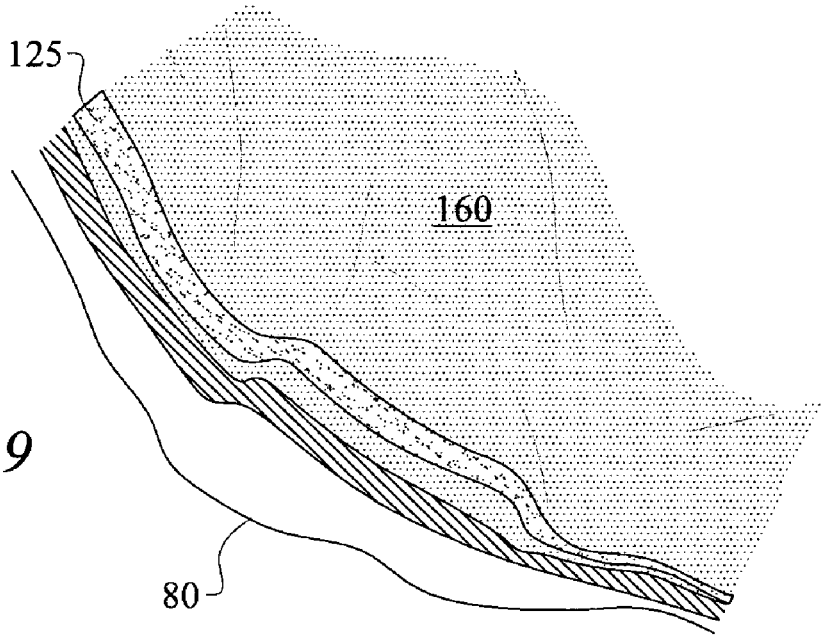
FIG. 9 is a view of the neck dam assembly heat-seamed to the protective respiratory hood according to an embodiment of the invention.
Figure 10:
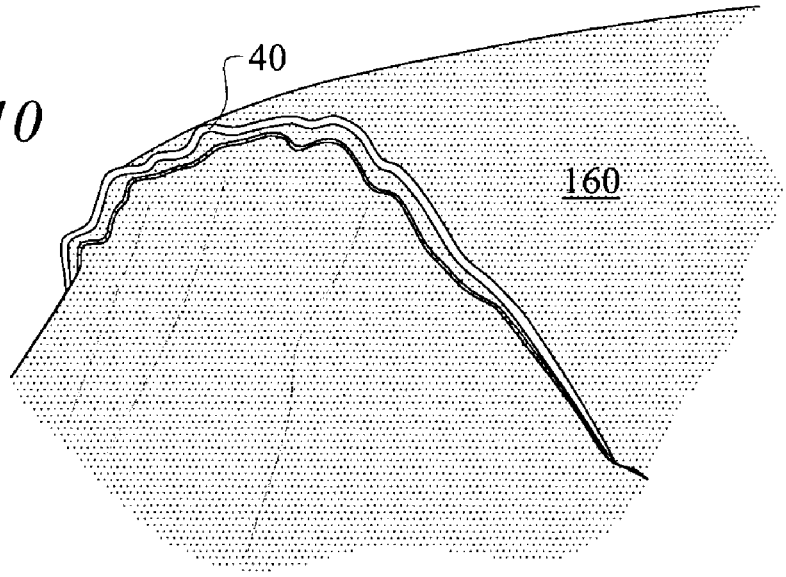
FIG. 10 is a view of a heat-seam joining two sections of the protective respiratory hood according to an embodiment of the invention.

FIG. 9 illustrates the seal between neck dam assembly 130 and hood bottom 50 as viewed with hood 10 folded inside-out. Heat seam 125 is viewed from fibrous side 160 of material 70 whereby film side 150 neck dam assembly 130 is fused to film side 150 of hood bottom 50. This film-to-film seam is both mechanical strong and fluid tight. The same film-to-film fusion seam 40 is created by heat fusing two inwardly folded pleats of material 70 about hood top 60 in FIG. 10.

What is claimed is:

1. A fluid impermeable interface between a polymer hood and an elastomeric neck dam, comprising:

a film composite material having a fluid impermeable outer surface and a fibrous backing inner surface;

at least one substantially fiber-free fluid barrier channel formed in said fibrous backing inner surface; and an adhesive disposed within said at least one substantially fiber-free fluid barrier channel to bond said elastomeric neck dam to the fibrous backing inner surface so that the adhesive forms a mechanical bond and a fluid barrier between the fibrous backing inner surface and the elastomeric neck dam.

2. The interface of claim 1 wherein the elastomeric neck dam is formed of a material that is selected from the group consisting of neoprene, butyl, and silicone.

3. The interface of claim 1 wherein the adhesive is polychloroprene.

4. The interface of claim 1 wherein said at least one substantially fiber-free fluid barrier channel includes a plurality of concentric fluid barrier channels.

5. A fluid impermeable neck dam assembly comprising:

an elastomeric neck dam;

a film composite ring having a fluid impermeable film outer surface and a fibrous backing inner surface;

at least one fluid barrier channel heat-formed in the fibrous backing inner surface of the ring, the channel having a smooth surface and being in concentric relation to a center axis of the elastomeric neck ring; and an adhesive disposed in said at least one fluid barrier channel for affixing the neck dam to the fibrous backing inner surface of the film composite ring to provide a mechanical bond and a fluid barrier between the fibrous backing inner surface and the elastomeric neck dam.

6. A protective respiratory hood comprising:

an elastomeric neck dam;

a film composite ring having a fluid impermeable film outer surface and a fibrous backing inner surface;

at least one fluid barrier channel heat-formed in the fibrous backing inner surface of the film composite ring, the channel having a smooth surface and being concentrically disposed relative to a center axis of said film composite ring;

a neck dam assembly formed by an adhesive disposed in said at least one fluid barrier for affixing the neck dam to the fibrous backing inner surface of the film composite ring;

a protective hood constructed of film composite material having a fluid impermeable film outer surface and a fibrous backing inner surface, the hood having a neck opening that mates the neck dam assembly around the outer perimeter of the film composite ring.

7. The protective hood of claim 6, further comprising a seam formed by heat fusing the film outer surface of the neck opening to the film outer surface of the film composite ring.

8. A protective respiratory hoods comprising:

an elastomeric neck dam;

a film composite ring having a fluid impermeable film outer surface and a fibrous backing inner surface;

at least one fluid barrier channel heat-formed in the fibrous backing inner surface of the ring, the channel having a smooth surface and being concentric with a center axis of the film composite ring;

an adhesive affixing the elastomeric neck dam to the fibrous backing inner surface of the film composite ring to form a neck dam assembly;

a protective hood constructed of film composite material having a fluid impermeable film outer surface and a fibrous backing inner surface, the protective hood having a neck opening that mates with the neck dam assembly around the film composite ring, a seam being formed by heat fusing the film outer surface of the hood neck opening to the film outer surface of the film composite ring.

9. A fluid impermeable elastomer-to-fibrous surface interface, comprising:

an elastomeric substrate selected from the group consisting of neoprene, butyl, and silicone;

a film composite material having a fluid impermeable surface and a fibrous backing;

at least one fluid barrier channel heat-formed in the fibrous backing, the channel having a smooth surface; and an adhesive selected from the group consisting of polychloroprene-based and silicone-based adhesives being disposed in said at least one fluid barrier channel for affixing the elastomeric substrate to the fibrous backing whereby a mechanical bond is formed by the adhesive's engagement with the fibrous backing and lateral fluid migration through the fibrous backing is blocked by the at least one fluid barrier channel filled with adhesive.

* * * * *